US011208795B2

(12) United States Patent
Kolarec et al.

(10) Patent No.: US 11,208,795 B2
(45) Date of Patent: Dec. 28, 2021

(54) FLOOR DRAIN FOR DRAINING WATER FROM A WALK-IN FLOOR INTO A SEWAGE PIPE

(71) Applicant: Viega Technology GmbH & Co. KG, Attendorn (DE)

(72) Inventors: Daniel Kolarec, Finnentrop (DE); Reinhard Schulte, Eslohe (DE); Marcel Helms, Driedorf (DE); Patrick Schäfer, Hagen (DE)

(73) Assignee: Viega Technology GmbH & Co. KG, Attendorn (DE)

( * ) Notice: Subject to any disclaimer, the term of this patent is extended or adjusted under 35 U.S.C. 154(b) by 0 days.

(21) Appl. No.: 16/808,615

(22) Filed: Mar. 4, 2020

(65) Prior Publication Data

US 2020/0284012 A1 Sep. 10, 2020

(30) Foreign Application Priority Data

Mar. 8, 2019 (DE) ..... 20 2019 001 078.5

(51) Int. Cl.

| | |
|---|---|
| ***E03C 1/282*** | (2006.01) |
| ***E03C 1/264*** | (2006.01) |
| ***E03C 1/28*** | (2006.01) |
| ***E03C 1/22*** | (2006.01) |

(52) U.S. Cl.

CPC ..... *E03C 1/282* (2013.01); *E03C 1/264* (2013.01); *E03C 1/281* (2013.01); *E03C 1/22* (2013.01)

(58) Field of Classification Search

CPC ..... E03C 1/282
USPC ..... 4/679, 378, 584, 613, 650, 668, 671; 137/247.41, 362, 577; 285/134.1
See application file for complete search history.

(56) References Cited

U.S. PATENT DOCUMENTS

2019/0316334 A1 10/2019 Larson

FOREIGN PATENT DOCUMENTS

| | | | |
|---|---|---|---|
| DE | 102005036576 | A1 | 7/2006 |
| DE | 102011053644 | A1 | 3/2013 |
| DE | 202014007357 | U1 | 12/2014 |
| DE | 202014007391 | U1 | 12/2014 |
| EP | 2322725 | A1 | 5/2011 |

*Primary Examiner* — Lori L Baker
(74) *Attorney, Agent, or Firm* — The Webb Law Firm

(57) ABSTRACT

The present invention relates to a floor drain for draining water from a walk-in floor into a waste water pipe, with an inlet channel socket, a first receiving body for the inlet channel socket, a second receiving body for the first receiving body and a drain housing following the second receiving body in the water drainage direction, which is preferably designed as an odor trap, wherein the first receiving body has a bowl-shaped section, to the outer edge of which a flexible sealing mat is connected in a liquid-tight manner and the bottom of which passes into a first drain connection piece which can be inserted into the second receiving body, wherein the second receiving body has a bowl-shaped section on which an outwardly projecting flange is integrally formed or attached, and wherein the bowl-shaped section of the second receiving body passes into a second drain connection piece.

19 Claims, 10 Drawing Sheets

FLOOR DRAIN FOR DRAINING WATER FROM A WALK-IN FLOOR INTO A SEWAGE PIPE

CROSS-REFERENCE TO RELATED APPLICATION

This application claims priority to German Patent Application No. 20 2019 001 078.5 filed Mar. 8, 2019, the disclosure of which is hereby incorporated by reference in its entirety.

BACKGROUND OF THE INVENTION

Field of the Invention

The invention relates to a floor drain for draining water from a walk-in floor into a sewage pipe, e.g. a floor drain for a shower.

Description of Related Art

Such floor drains are known in numerous designs. In particular, such floor drains are known which have a drain body designed as an odor trap with a usually square inlet grating which can be removed from the drain body. Such floor drains cover a horizontal area of limited extension, whereby the floor in the vicinity of the grating or the inlet opening of the drain body is usually designed with a slope leading the water to the floor drain. Such floor drains are also referred to as point drains due to their more or less "punctiform" mode of operation.

Furthermore, floor drains are known which are designed as so-called "shower channels". These channel-shaped floor drains extend in a horizontal dimension considerably further than in the dimension perpendicular thereto, whereby the water to be drained is collected via a channel. Conventional shower channels have a channel body to be built into the floor, in which the water is collected and which is provided on the upper side with an elongated grating or an elongated cover which delimits a circumferential inlet gap. Furthermore, shower channels are also known in which the channel is open at the top and has a slightly troughed channel profile over the major part of its longitudinal extension, which serves to collect and lead the water to a drain opening. The topside profile of the channel body thus provides surface-guided point drainage. The floor drain according to the invention can preferably comprise such a channel body.

Floor drains must be positioned, fastened and sealed according to structural conditions. For example, the desired or specified installation position of the floor drain can be at a distance from a room wall or flush with a room wall. The visible ends of a channel body should preferably or, if necessary, must be flush with joints of floor tiles. The construction height of the floor drain must generally be adapted to the height of the screed and floor covering. The floor drain should be reliably fastened to prevent the position of the floor drain from changing during installation, especially during screed laying or filling. In particular, reliable sealing of the floor drain must be ensured to prevent structural damage caused by moisture penetrating the floor.

From DE 20 2014 007 357 U1 a floor drain of the type mentioned above is known. The floor drain has an inlet pipe socket, a receiving pipe for the inlet pipe socket, a flexible sealing mat which is attached to the receiving pipe in an upper area of the receiving pipe, and a cover under which the sealing mat is placed in a protected position. The cover protects the sealing mat from mechanical damage and dirt. The cover is removable to allow the sealing mat to be placed on the floor when the floor drain is installed. The floor drain known from DE 20 2014 007 357 U1 appears to be capable of improvement.

The present invention is based on the object of creating a floor drain of the type mentioned above, which is further improved in terms of simplicity and safety of installation.

SUMMARY OF THE INVENTION

The floor drain according to the invention is characterized by an inlet channel socket, a first receiving body for the inlet channel socket, a second receiving body for the first receiving body and a drain housing following the second receiving body in the water drainage direction, which is preferably designed as an odor trap, wherein the first receiving body has a bowl-shaped section, to the outer edge of which a flexible sealing mat is connected in a liquid-tight manner and the bottom of which passes into a first drain connecting piece which can be inserted into the second receiving body, wherein the second receiving body has a bowl-shaped portion on which an outwardly projecting flange is integrally formed or attached, and wherein the bowl-shaped portion of the second receiving body passes into a second drain connecting piece.

By subdividing the floor drain into an inlet channel socket, a first receiving body for the inlet channel socket, a second receiving body for the first receiving body and a drain housing following the second receiving body in the water drainage direction, an optimum adaptation of the floor drain to the height of the screed and floor covering and a simple fine adjustment of the visible drain section, preferably a channel body, relative to adjacent joints of the floor covering can be achieved. The inlet channel socket can also be used in particular as a height compensation piece and—if necessary—be adapted to the height or thickness of the floor covering, e.g. the tile height. The flange moulded or attached to the bowl-shaped section of the second receiving body allows the floor drain to be reliably fixed so that its installation position is firmly secured during subsequent installation steps. For this purpose, the flange preferably has several recesses through which flowable screed or adhesive can penetrate the flange, so that the flange and thus the floor drain are firmly anchored in the screed or adhesive after the screed or adhesive has hardened. Together with the bowl-shaped section of the second receiving body, the flange can also be called as inlet flange.

The flexible sealing mat, which is connected to the bowl-shaped section of the first receiving body in a liquid-tight manner, enables the floor drain to be sealed simply and reliably against its surroundings in different installation situations, especially when the floor drain is positioned flush with a wall. The flexible sealing mat together with the bowl-shaped section of the corresponding receiving body can also be called as a sealing collar. The sealing mat preferably has holes in its edge or edge corners in order to achieve a form-fit connection of the sealing mat with an adhesive material and/or a so-called liquid foil applied to the screed or a wall.

An advantageous embodiment of the invention is characterized in that the first drain connecting piece has an annular seal arranged on its outer circumference. This makes it possible to achieve a very secure and easy to produce seal for the floor drain. An O-ring is preferably used as the annular seal, which is inserted into an annular groove formed on the outer circumference of the first drain connecting piece.

According to a further advantageous embodiment of the invention, the bowl-shaped section of the first receiving body and the bowl-shaped section of the second receiving body are provided with snap-in elements associated with each other, which, when the bowl-shaped section of the first receiving body is arranged in the bowl-shaped section of the second receiving body, can be locked or latched together. The snap-in elements of the bowl-shaped section of the first receiving body are designed, for example, in the form of snap-in springs or snap-in lugs, which can also be described as clip corners. The snap-in connection of the bowl-shaped section of the first receiving body with the bowl-shaped section of the second receiving body provides a secure seal between the flange (inlet flange) and the sealing mat (sealing collar). An advantage that the installer or tiler will appreciate. The snap-in effect, which is important for a secure seal, can be clearly perceived acoustically and/or visually when the sealing mat is mounted on the flange.

Preferably, the bowl-shaped section of the first receiving body and the bowl-shaped section of the second receiving body have at least four pairs of snap-in elements which can be locked together when the bowl-shaped section of the first receiving body is arranged in the bowl-shaped section of the second receiving body, four of the snap-in elements being arranged on opposite outer sides of the bowl-shaped section of the first receiving body.

Preferably, the bowl-shaped sections of the two receiving bodies each have a circumferential shoulder which frames a sloping bottom with a circular drainage opening. Preferably, the circular drainage opening is arranged centrally, wherein the bottom has at least two sloping surfaces ending at the drainage opening in the manner of a funnel.

A further advantageous embodiment of the floor drain according to the invention provides that the bowl-shaped section of the first receiving body is dimensioned larger than the inlet channel socket, so that the inlet channel socket is received in the bowl-shaped section so as to be horizontally displaceable relative to the bowl-shaped section of the first receiving body. Preferably, the inlet channel socket is received in the bowl-shaped section of the first receiving body so that it can be displaced horizontally in at least two directions running transversely to one another. Thus, inaccuracies in the fit when installing the floor drain can be compensated for to a certain extent by horizontally displacing the inlet channel socket relative to the bowl-shaped section of the first receiving body (sealing collar).

Preferably, the inlet channel socket, which serves in particular as a height compensation piece, has one or more circumferential grooves on its outer circumference, each of which can be used as a guide for a cutting tool, e.g. a knife, for shortening the inlet channel socket. The respective groove can also be called a cutting groove. For example, the height of the inlet channel socket may be in the range of approx. 15 to 50 mm, preferably 15 to 35 mm, and may have a number of parallel circumferential grooves in the range of 3 to 10, preferably in the range of 5 to 8 grooves (cutting grooves). Preferably, the wall thickness of the inlet channel socket at the bottom of the groove is significantly less than next to the groove bottom and has perforations in sections, which makes it easier to shorten the inlet channel socket.

According to a further advantageous embodiment of the invention, the flange of the bowl-shaped section (inlet flange) of the second receiving body has at least one groove which runs parallel to an edge of the bowl-shaped section of the second receiving body, the groove being spaced not more than 10 mm, preferably less than 5 mm, from the edge of the bowl-shaped section. This groove also serves as a cutting groove. Preferably, the wall thickness of the flange at the bottom of the groove is significantly less than next to the bottom of the groove, which makes it easier to cut off a specific flange area. By cutting off a specific flange area, the floor drain can be placed closer or directly against a room wall of a wet room or shower. This allows the floor drain to be positioned at various positions on a wet room floor surface. For example, the floor drain according to the invention can be positioned at a distance from the wall of a shower compartment, centrally or decentrally in the floor area of the shower compartment or directly on the wall of a shower compartment.

The bowl-shaped section of the second receiving body and its flange are preferably of elongated design, the bowl-shaped section and the flange having two longitudinal sections parallel to one another, which are connected to one another by two shorter transverse sections parallel to one another. The respective longitudinal section can, for example, be approximately twice as long as the respective transverse section of the flange. Preferably, the parallel longitudinal sections run essentially at right angles to the parallel transverse sections.

Between the bowl-shaped section of the second receiving body and its flange there is formed preferably an upwardly projecting web, which is preferably designed as a closed web. The at least one groove (cutting groove) runs for example in at least one of the longitudinal sections of the flange, directly along the web. Preferably also the other longitudinal section and the two mutually parallel transverse sections of the flange are each provided with at least one groove (cutting groove), wherein the grooves cross in the connecting region of the longitudinal and transverse sections and preferably extend to the outer periphery of the flange.

With regard to a perfect alignment of the part of the floor drain still visible in the finished installed state of the floor drain and having the water inlet opening, it is advantageous if, according to further embodiment of the invention, the second receiving body in liquid-tight connection with the drain housing is rotatable about a vertical axis relative to the drain housing. Thus, the flange (inlet flange) of the second receiving body can be rotated essentially independently of the orientation of the drain housing and thus be optimally aligned relative to an adjacent wall of a shower compartment.

Furthermore, the floor drain according to the invention can contain a protective cover for completely covering the bowl-shaped section of the second receiving body, whereby the protective cover is positively and detachably connected to the edge of the bowl-shaped section of the second receiving body. In particular, the protective cover can reliably prevent screed from penetrating into the drain housing during the installation of the floor drain.

A further embodiment of the floor drain in accordance with the invention provides that the inlet channel socket has a connecting section at the top for the positive and/or liquid-tight connection of a water collecting means, preferably an elongated water collecting body with multiple gradients, the water collecting means or the water collecting body containing an opening through which collected water can drain off.

Furthermore, the floor drain according to the invention can comprise such a water collecting means, preferably in the form of an elongated water collecting body with multiple gradients, the water collecting means or the water collecting body having an opening, preferably a gap-shaped opening, through which collected water can drain off. The topside profile of the water collecting body is preferably designed for surface-guided point drainage. The gradient of the water collecting body can be in the range of approx. 1 to 3%, for example.

According to a further advantageous embodiment of the floor drain according to the invention, the bowl-shaped section of the first receiving body is provided with a sieve insert. This allows coarser particles and/or hairs that have passed through the inlet opening to be collected so that they do not get into the drain housing or the drain trap.

A further advantageous embodiment of the floor drain according to the invention provides that the water collecting means or the elongated water collecting body has an insert receptacle above the bowl-shaped section of the second receiving body with an insert positively received therein, the insert having the opening (inlet opening), preferably the gap-shaped opening, through which collected water can drain off. After removal of the insert, the bowl-shaped section of the first receiving body is accessible for cleaning purposes, in particular for removing and cleaning the screen insert. The insert can also be called a grate and has several openings.

BRIEF DESCRIPTION OF THE DRAWINGS

In the following, the invention is explained in more detail on the basis of a drawing illustrating exemplary embodiments.

DESCRIPTION OF THE INVENTION

Figure 1:
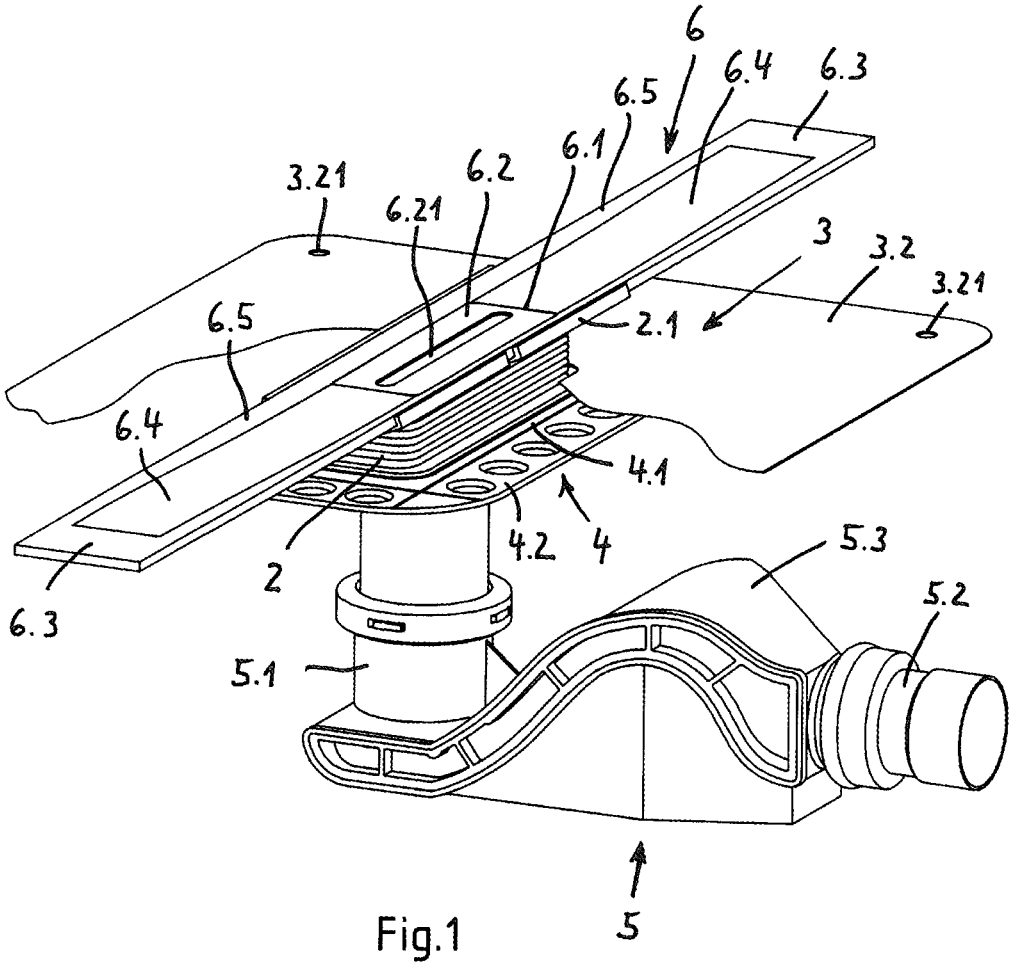
FIG. 1 shows a floor drain according to the invention in a perspective view, wherein a flexible sealing mat is only shown in a section.
Figure 2:
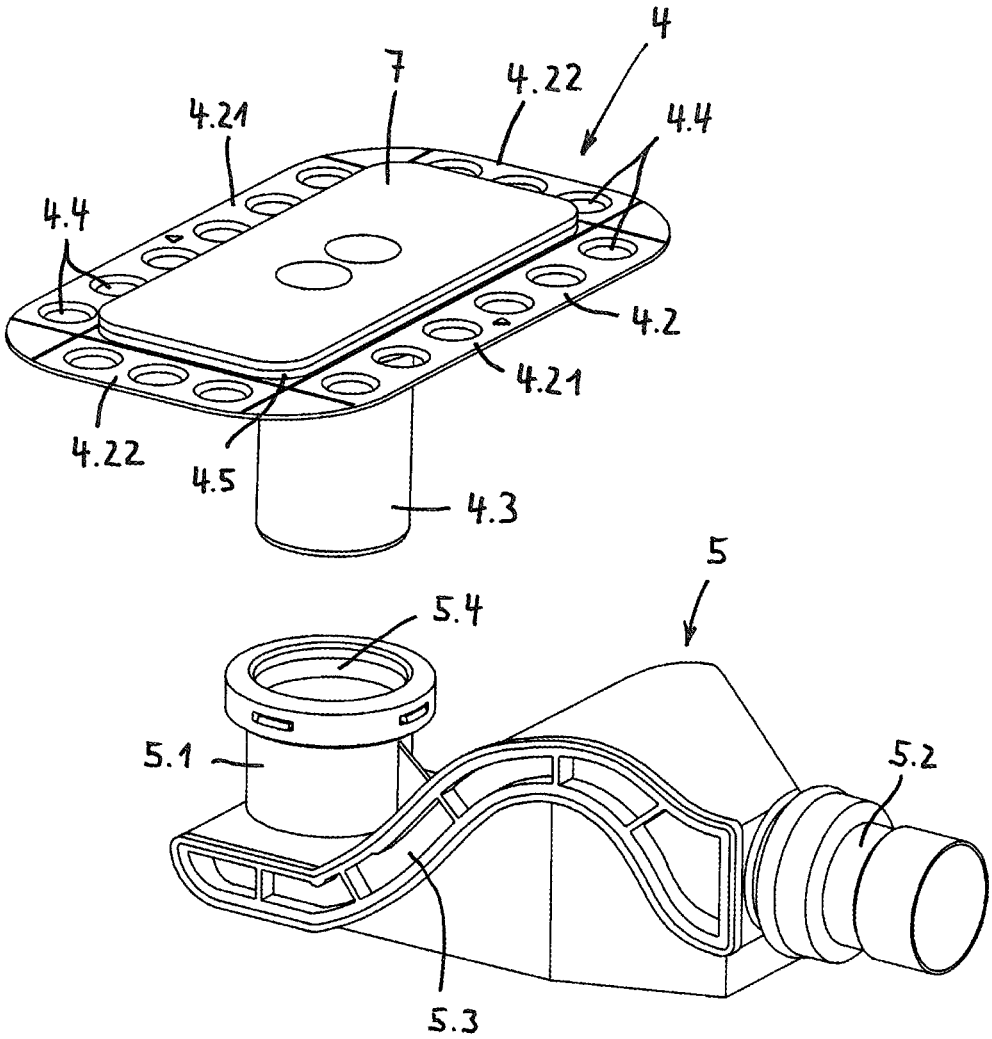
FIG. 2 shows the receiving body comprising a flange, a bowl-shaped section and a drain connecting piece and the drain housing of the floor drain in a perspective exploded view, wherein a protective cover is inserted into the bowl-shaped section.

The floor drain 1 shown in the drawing serves to drain water from an walk-in floor into a sewage pipe. The floor drain 1 comprises an inlet channel socket 2, a first or upper receiving body 3 for the inlet channel socket 2, a second or lower receiving body 4 for the first or upper receiving body 3 and a drain housing 5 following the second or lower receiving body 4 in the water drainage direction, which is preferably designed as an odor trap.

Figure 7:
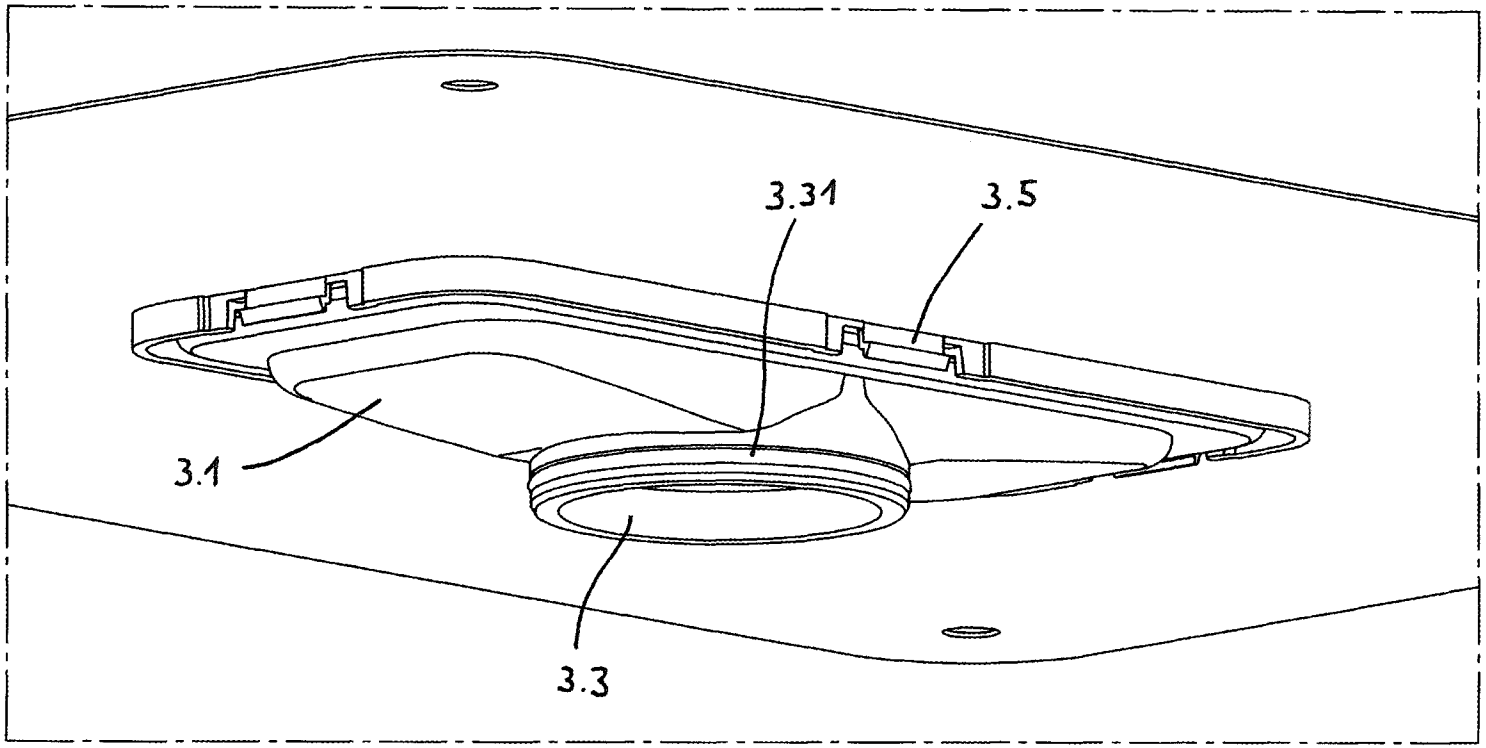
FIG. 7 shows a detailed representation of the bowl-shaped section and the drain connecting piece of the receiving body from FIG. 6, in a perspective bottom view.

The first receiving body 3 has a bowl-shaped section 3.1, to the outer edge of which a flexible sealing mat (sealing membrane) 3.2 is connected liquid-tight and the base of which passes into a drain connecting piece 3.3 (cf. FIG. 7), which can be inserted into the second receiving body 4. The second receiving body 4 has a bowl-shaped section 4.1, to which an outwardly projecting flange 4.2 is attached, preferably integrally formed, whereby the bowl-shaped section 4.1 passes into a second drain connecting piece 4.3.

The inlet channel socket 2 has a connecting section 2.1 on the top side for the positive and/or liquid-tight connection of a water collecting medium, preferably an elongated water collecting body 6 having multiple gradients. The elongated water collecting body 6, which can also be called a shower channel, has an opening 6.1 above the bowl-shaped section 4.1 of the second receiving body 4, which is designed as an insert receptacle, in which an insert 6.2 is positively received and held. The exchangeable insert 6.2 has at least one opening 6.21, preferably a gap-shaped opening 6.21, through which water collected by means of the water collecting body 6 can drain off. For vertical support of the insert 6.2, the insert receptacle is provided on its inner circumference with at least two opposite shoulders or one circumferential shoulder (not shown) on which the insert 6.2 rests. The upper side of the insert 6.2 inserted in the insert receptacle is preferably flush with the surface of the water collecting body 6. The channel-like water collecting body 6 has a relatively small gradient 6.4 running from its respective narrow front end 6.3 in the direction of the insert receptacle 6.1, which is preferably in the range of approx. 1 to 3%, particularly preferably in the range of approx. 1 to 2%. In addition, the water collecting body 6 has a concave or trough-shaped cross-sectional profile on its upper side, the height of the lateral flanks 6.5 of the cross-sectional profile increasing from the respective narrow front end 6.3 in the direction of the insert receptacle 6.1. This results in a multiple gradient, whereby the surface profile of the water collecting body 6 causes surface-guided drainage. The water collecting body 6 and the insert 6.2 are preferably made of stainless steel.

The drain housing 5 has a vertical pipe socket (inlet socket) 5.1 and a drain connecting piece (outlet socket) 5.2 which runs horizontally, for example. The vertical pipe socket 5.1 and the outlet socket 5.2 to be connected to a sewage pipe (not shown) are connected to each other via an S-shaped channel section 5.3. Together with the vertical pipe socket 5.1, the S-shaped channel section 5.3 forms an odor trap in which, when the floor drain 1 is in use, sealing water is present at a certain height of, for example, approx. 50 mm.

The vertical pipe socket 5.1 is provided at the upper end with an annular seal 5.4, which seals the drain connecting piece 4.3 of the receiving body 4 inserted in the pipe socket 5.1 in a liquid-tight manner. The receiving body 4 can be rotated about a vertical axis relative to the drain body 5. If required, the pipe socket 5.1 or the drain connecting piece 4.3 can be extended by an optional pipe (not shown) in order to be able to realise greater overall heights if necessary.

The bowl-shaped section 4.1 of the receiving body 4 and its flange 4.2 are elongated, wherein the bowl-shaped section 4.1 and the flange 4.2 have two parallel longitudinal sections 4.21, which are connected to each other by two shorter, parallel transverse sections 4.22. The length of the bowl-shaped section 4.1 measures, for example, approximately twice its width. The parallel longitudinal sections 4.21 of the flange are substantially perpendicular to the parallel transverse sections 4.22 of the flange. The flange 4.2 is provided with several recesses, preferably holes 4.4, which serve to anchor the receiving body 4 in a screed mass with which the drain body 5 positioned on an unfinished floor is cast during a subsequent assembly step. The flange 4.2 thus represents a reinforcement area with recesses, preferably a perforated reinforcement area.

Between the bowl-shaped section 4.1 and the flange 4.2 an upwardly projecting web 4.5 is formed, which is preferably designed as a closed web 4.5. A protective cover 7 is preferably inserted into the bowl-shaped section 4.1 until the screed work is completed. The protective cover 7 is dimensioned so that it completely covers the bowl-shaped section 4.1. Preferably, the protective cover 7 also covers the upper side of the web 4.5 essentially completely. The protective cover 7 is detachably and positively connected with the web 4.5 or the edge of the bowl-shaped section 4.1.

Figure 3:
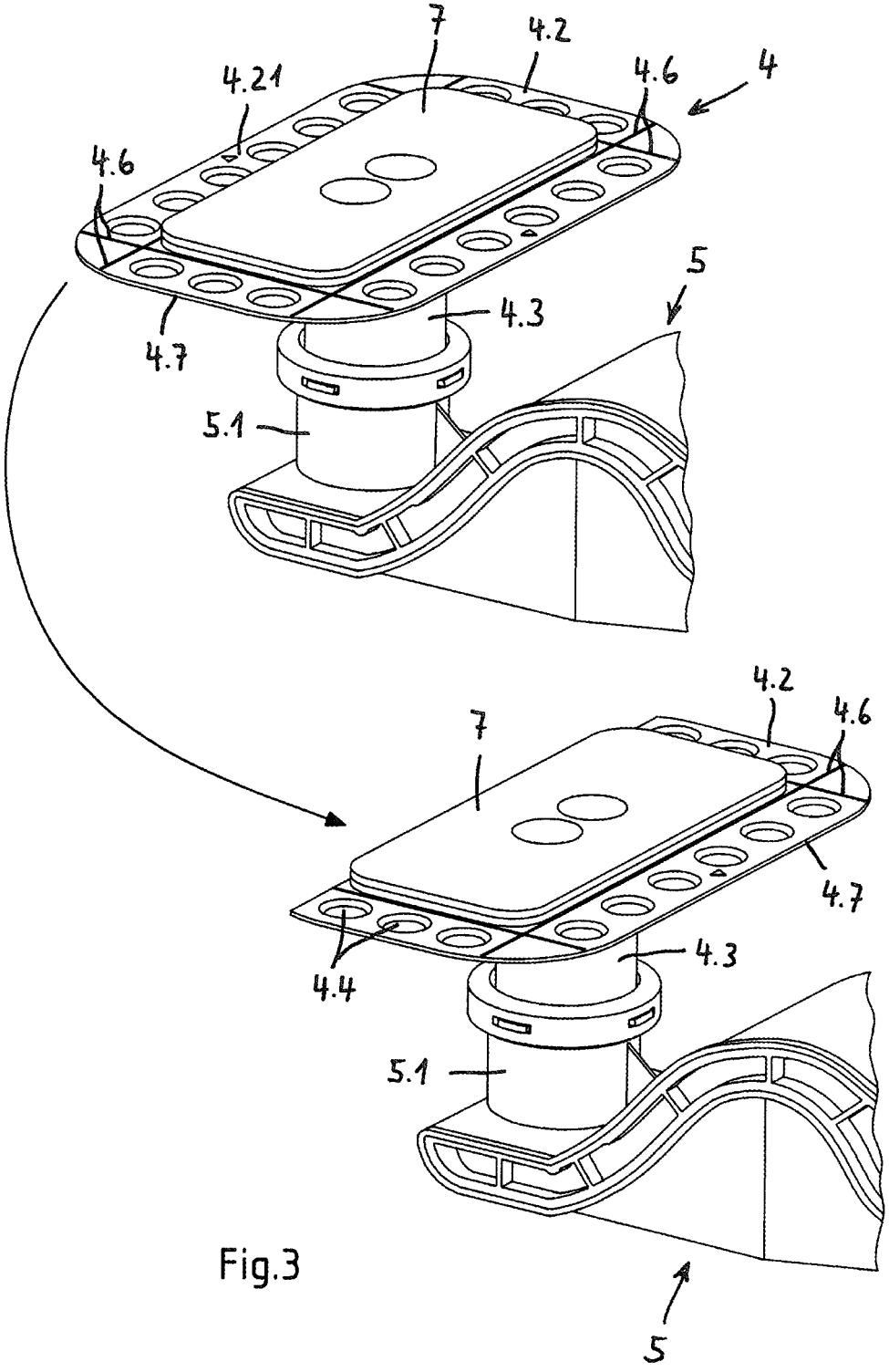
FIG. 3 shows further representations of the flange on the bowl-shaped section with inserted protective cover.

The flange 4.2 has straight grooves 4.6 on its upper side, which run parallel to the four sides of the web 4.5 or the edge of the bowl-shaped section 4.1. The grooves 4.6 preferably run directly along the web 4.5, with the grooves 4.6 extending to the peripheral edge 4.7 of the flange 4.2. The grooves 4.6 serve as cutting grooves and enable a section of the flange 4.2, in particular an elongated flange section 4.21, to be cut off easily (cf. FIG. 3). After cutting off an oblong section 4.21 of the flange, the web 4.5 can be positioned directly on a vertical wall of a shower compartment with the bowl-shaped section 4.1 of the receiving body 4 inserted into the drain housing 5 or the water collecting body (channel body) 6 fitted later.

If, on the other hand, the water collecting body (channel body) 6 is to be positioned centrally or decentrally, i.e. at a clear distance from the vertical wall or walls of a shower compartment, it is not necessary to separate a section 4.21 of the flange 4.2. In this case, the flange 4.2 with the bowl-shaped section 4.1 of the receiving body 4 can still be rotated by up to 360° after it has been mounted on the drain housing 5. The bowl-shaped section 4.1 of the receiving body 4 and thus finally the elongated water collecting body (channel body) 6 can in this case be installed variably at an angle in the range of 0° to 90° to an adjacent wall of the shower compartment.

Figure 4:
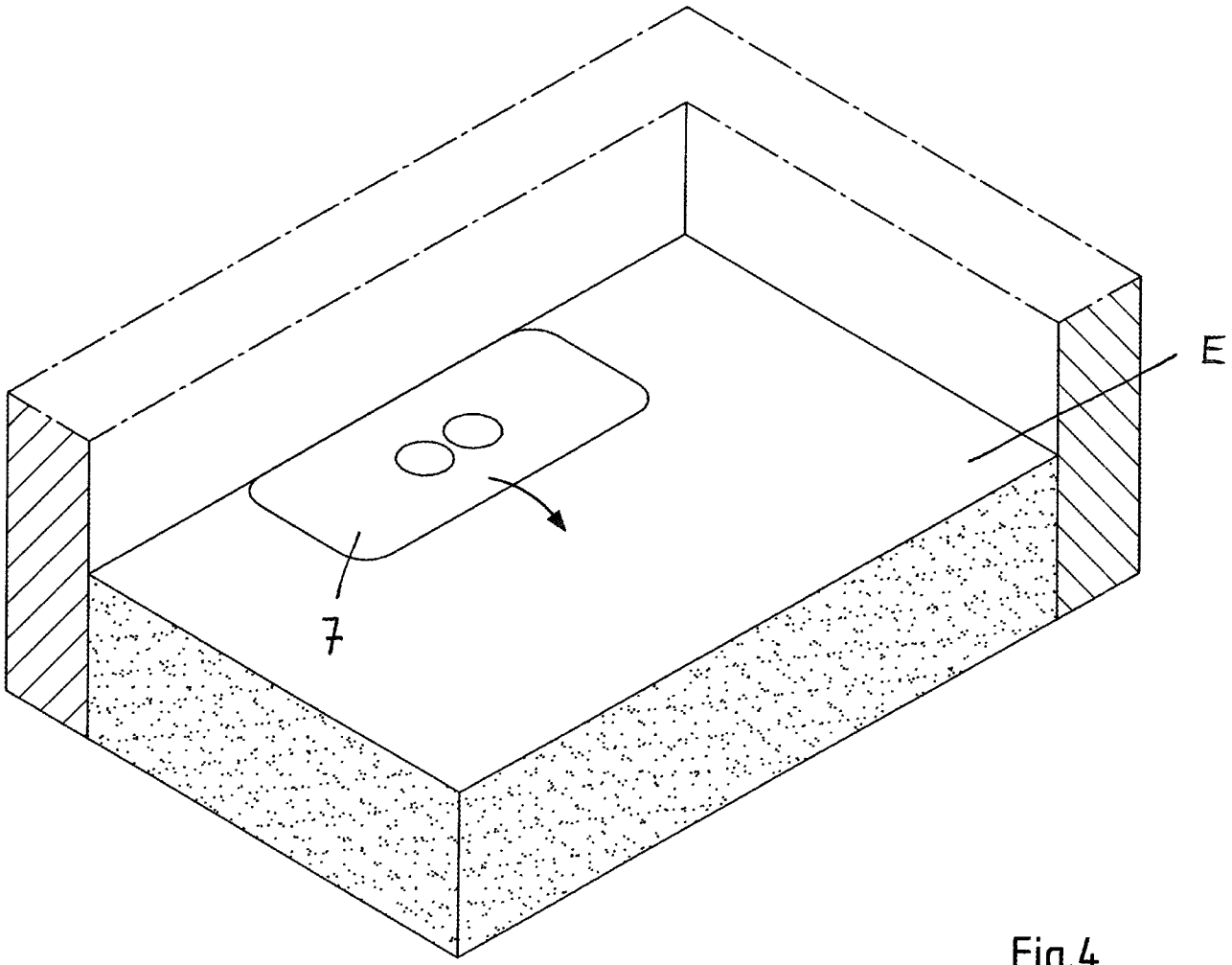
FIG. 4 shows an assembly condition after positioning and assembly of the drain housing and the receiving body with the protective cover and after flush insertion of screed, in a perspective exploded view.

After completion of the positioning of the drain housing 5 with the receiving body 4 inserted into it and after adjustment and installation of the sewage pipe (not shown) on the drain connecting piece 5.2 of the drain housing 5, screed E is placed in the area surrounding the drain housing 5 in such a way that the screed E is flush with the top of the protective cover 7 (FIG. 4). The protective cover is preferably removed after the screed has hardened (FIG. 5).

Figure 5:
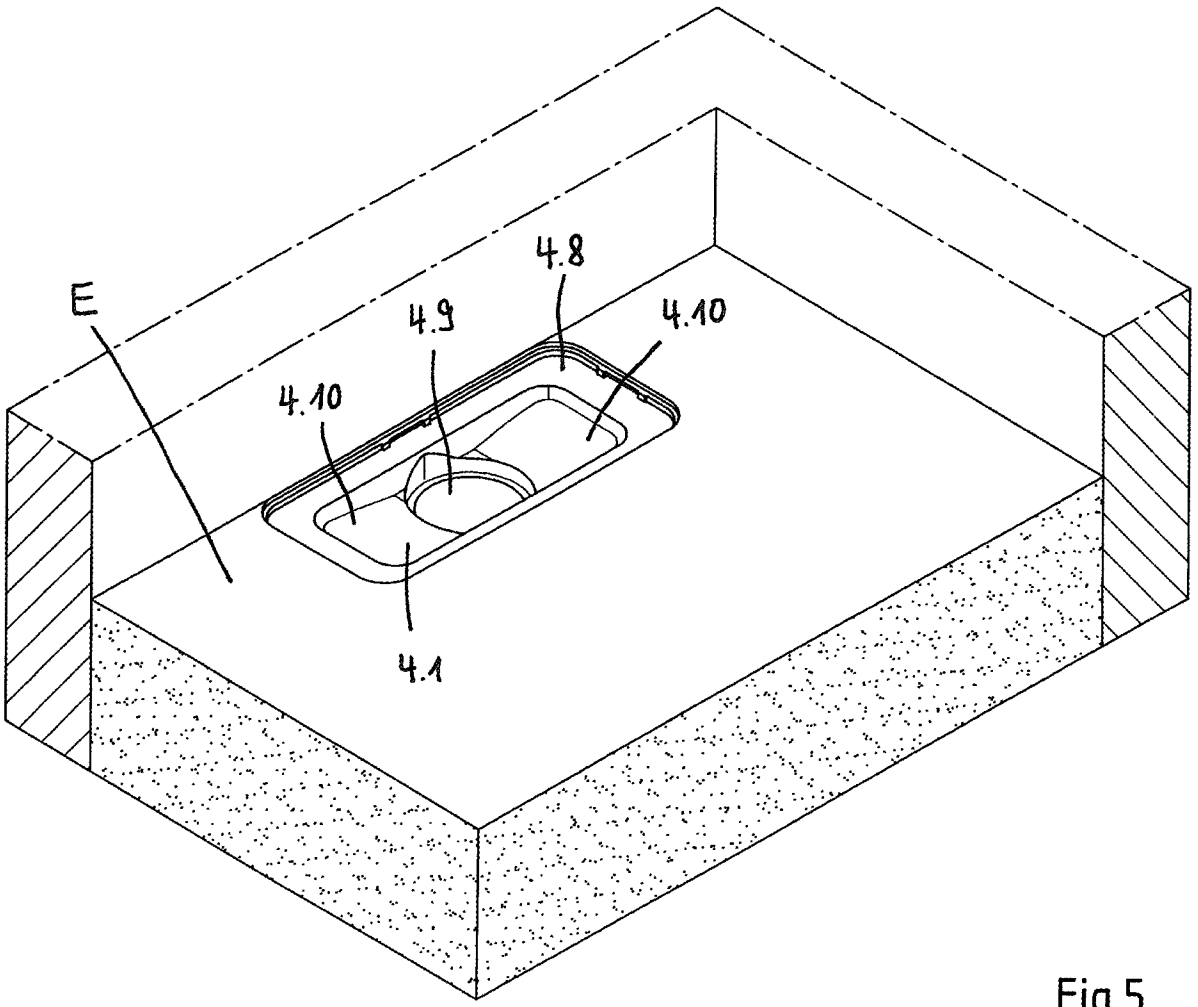
FIG. 5 shows a subsequent assembly state after removal of the protective cover.
Figure 6:
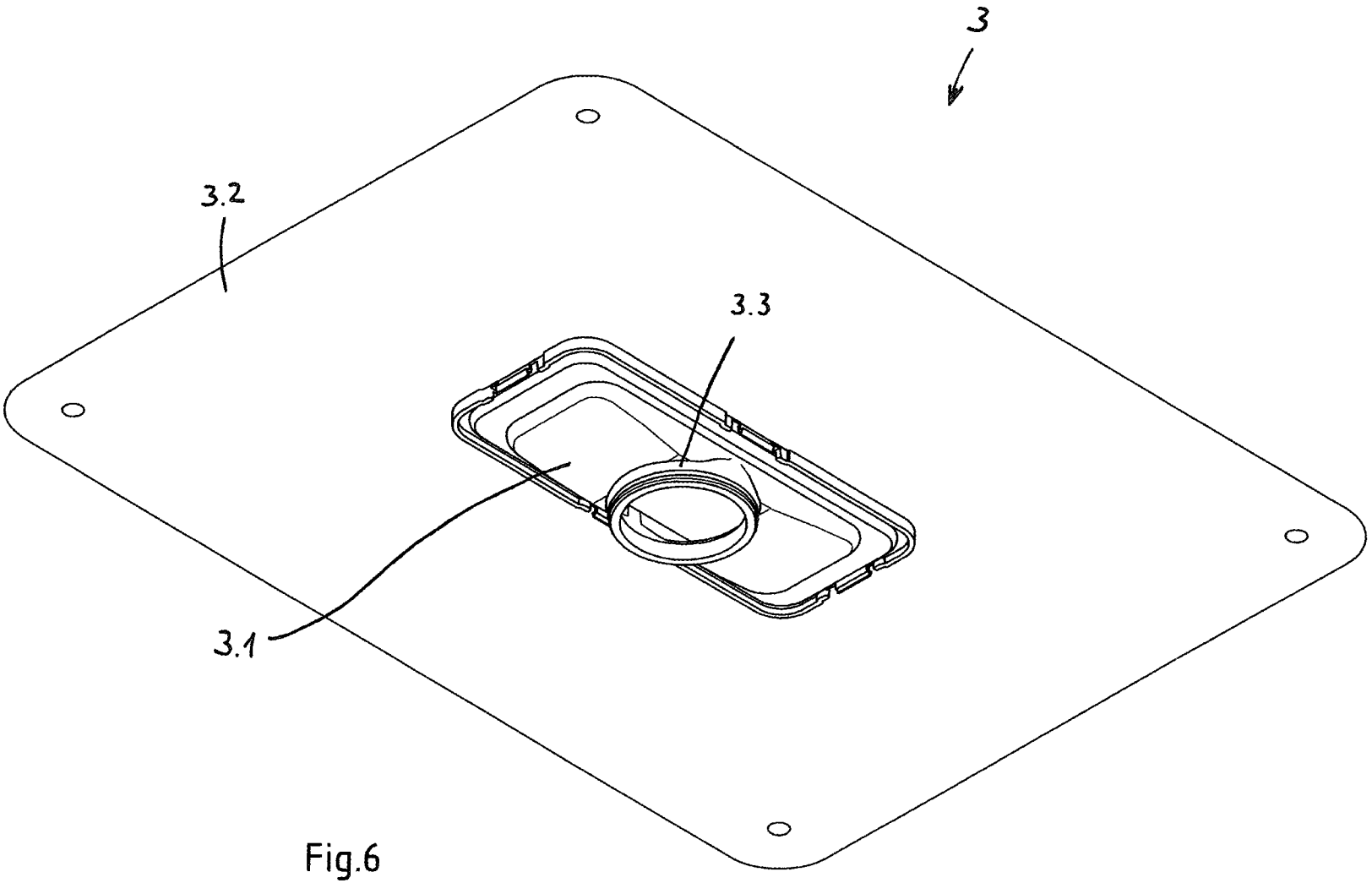
FIG. 6 shows the receiving body, which comprises a bowl-shaped section with drain connecting piece and a flexible sealing mat, in a perspective bottom view.

Subsequently, the bowl-shaped section 3.1 of the first receptacle body 3, to the outer edge of which the flexible sealing mat 3.2 is connected liquid-tight and the base of which passes into the drain connecting piece 3.3 (cf. FIG. 7), is inserted into the bowl-shaped section 4.1 of the second receiving body 4 anchored in the screed E (FIG. 5).

The circular drain connecting piece 3.3 is provided with an annular seal (not shown), preferably an O-ring, on its outer circumference. The annular seal is held in an annular groove 3.31 formed on the outer circumference of the drain connecting piece 3.3.

The bowl-shaped section 3.1 of the upper receiving body 3 and the bowl-shaped section 4.1 of the lower receiving body 4 are provided with mutually assigned snap-in elements 3.5 which lock together when the bowl-shaped section 3.1 of the upper receiving body 3 is inserted into the bowl-shaped section 4.1 of the lower receiving body 4. The drawing shows only one of the snap-in elements 3.5, namely a snap-in element 3.5 of the bowl-shaped section 3.1 of the upper receiving body 3.

The snap-in elements 3.5 of the bowl-shaped section 3.1 of the upper receiving body 3 are designed, for example, in the form of snap-in springs (clip corners). The snap-in connection of the two bowl-shaped sections 3.1, 4.1 provides a reliable seal between the sealing mat 3.2 of the upper receiving body 3 and the drain connecting piece 4.3 of the lower receiving body 4.

Preferably, the two bowl-shaped sections 3.1, 4.1 have four pairs of snap-in elements 3.5 which are assigned to each other and which interlock with each other in the bowl-shaped section 4.1 of the lower receiving body 4 when the bowl-shaped section 3.1 of the upper receiving body 3 is fitted, wherein one pair of these snap-in elements 3.5 is arranged on each of the four sides of the bowl-shaped sections 3.1, 4.1.

The bowl-shaped sections 3.1, 4.1 each have a circumferential shoulder 3.8, 4.8 which frames a sloping bottom with a circular drainage opening 3.9, 4.9. Preferably, the circular drainage opening 3.9, 4.9 is arranged centrally, wherein the bottom has two sloping surfaces 3.10, 4.10 ending at the drainage opening in the manner of a funnel (cf. FIG. 8).

Figure 8:
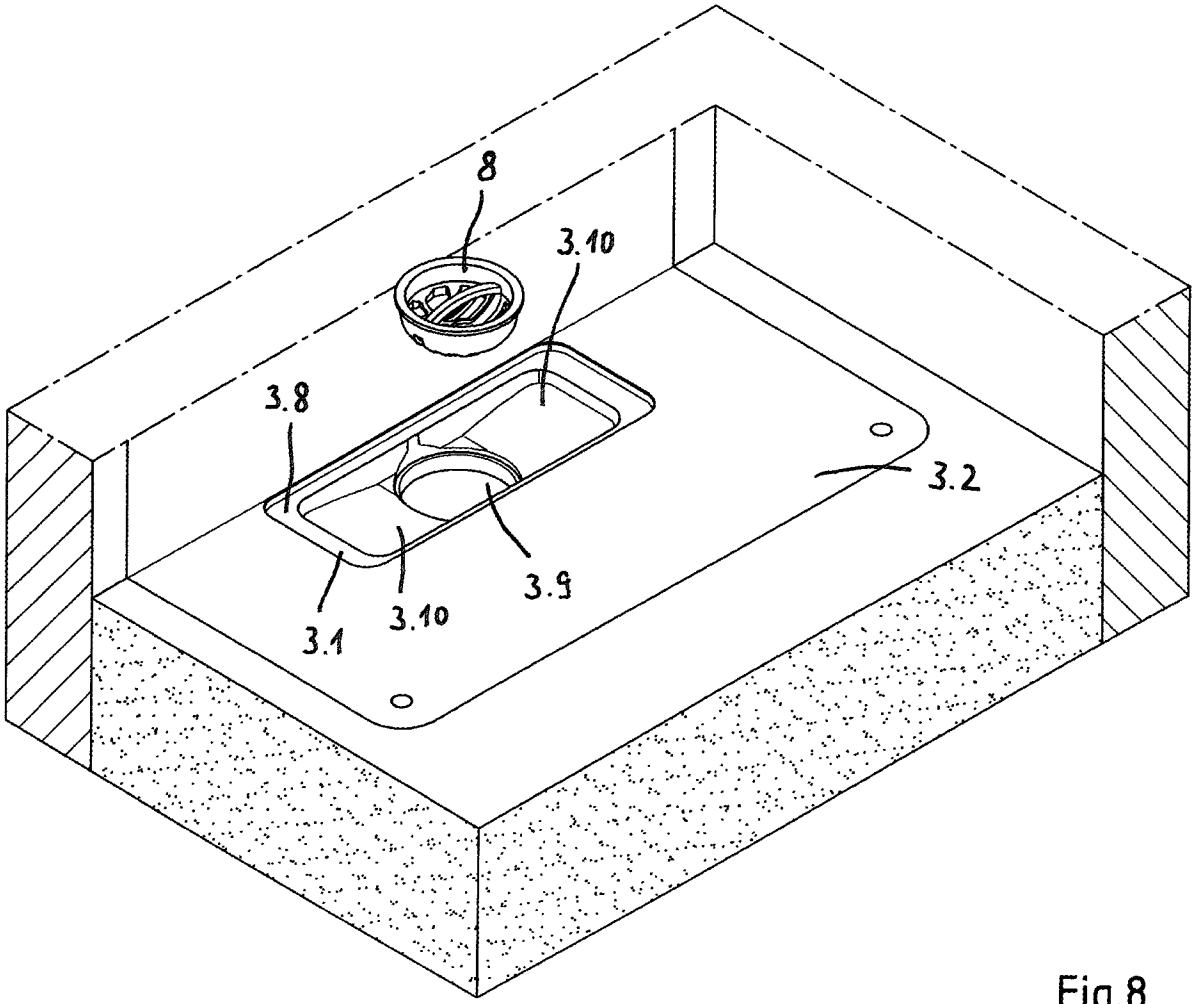
FIG. 8 shows an assembly condition after attaching the sealing mat to the screed and inserting a screen insert, in a perspective top view.

FIG. 8 shows an installation condition of the floor drain after attaching the sealing mat 3.2 to the screed. The screed is preferably sealed outside the flexible sealing mat 3.2 with additional sealing material, for example with liquid-applied sealing material which can be applied in liquid form and solidifies to form a film (so-called liquid film), into which the sealing mat 3.2 is worked. In this way a flexible composite sealing is produced. The sealing mat 3.2 can have holes 3.21 in its edge corners (FIG. 1) in order to achieve a form-fit connection of the sealing mat 3.2 with an adhesive material or sealing material applied to the screed or a wall, in particular a liquid foil.

The bowl-shaped section 3.1 of the upper receiving body 3 has a circumferential shoulder at its drainage opening 3.9, which serves as a holder for a sieve insert 8 that can be inserted into the receiving body 3.

After the flexible sealing mat 3.2 with additional sealing material, preferably liquid foil, as a composite seal has been attached to the screed E and, if necessary, to the adjacent wall of the shower compartment and dried, the inlet channel socket 2 is inserted into the bowl-shaped section 3.1 of the upper receiving body 3. The inlet channel socket 2 is designed as a height compensation piece in order to be able to adapt the height position of the channel-like water collecting body 6 to the height of a floor tile or stone slab covering to be applied to the sealing mat 3.2. For this purpose, the inlet channel socket 2 is made of easily cut plastic, e.g. polypropylene, and has a plurality of circumferential, mutually parallel grooves (cutting grooves) 2.2, preferably with hole perforation, each of which can be used as a guide for a knife for shortening the inlet channel socket 2.

Figure 9:
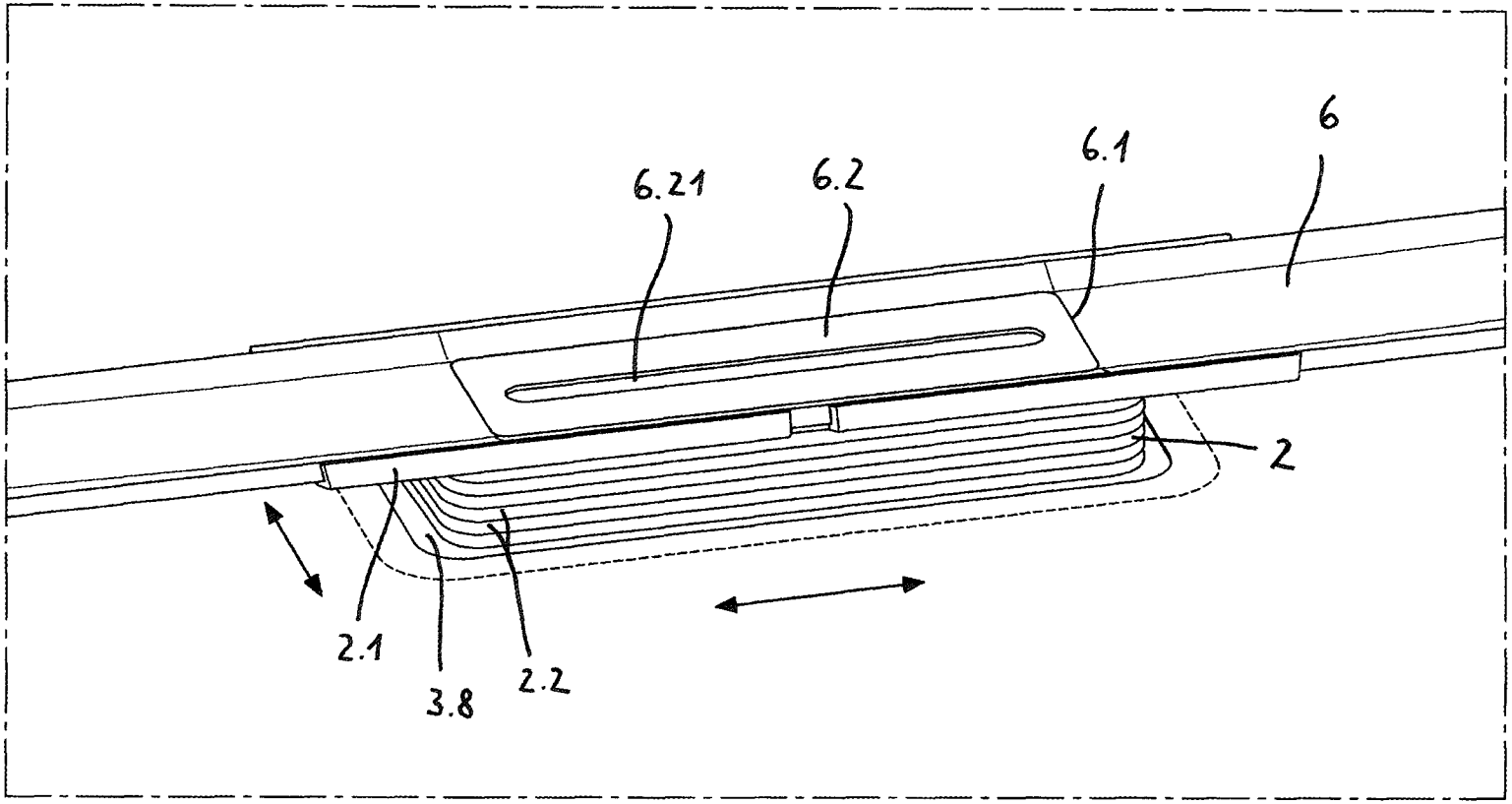
FIG. 9 shows an assembly condition after inserting the inlet channel socket (height compensation piece) into the bowl-shaped section of the receiving body from FIG. 6 with the elongated water collecting body (shower channel) placed on top, in a perspective top view.
Figure 10:
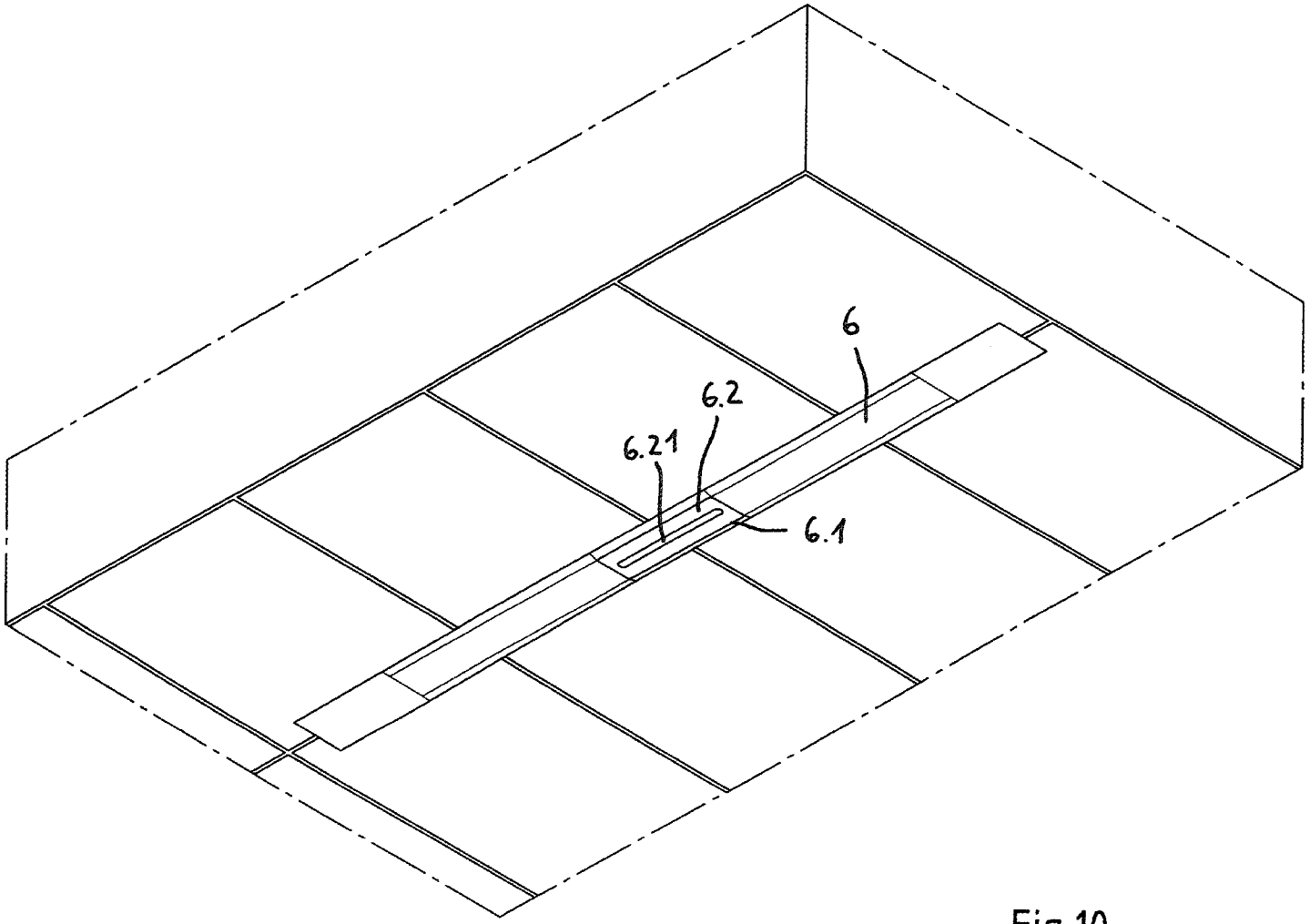
FIG. 10 shows the completed installation condition with visible elongated water collecting body and inlet opening, in a perspective plan view.

Furthermore, it can be seen in FIG. 9 that the bowl-shaped section 3.1 of the receiving body 3 is dimensioned larger than the inlet channel socket 2, so that the inlet channel socket 2, which is received in the bowl-shaped section 3.1 of the upper receiving body 3, can be horizontally displaced in two directions running transversely to each other. In particular, the distance of the trough-shaped water collecting body 6 from an adjacent wall and/or the position of the inlet opening 6.21 relative to a floor covering joint can thus be adjusted. The inlet channel socket 2, which can be shortened in height, rests with its lower edge on the circumferential shoulder 3.8 of the bowl-shaped section 3.1.

In addition, the gutter-like water collecting body 6, which is preferably made of stainless steel and is designed to be resistant to deformation, can be shortened by means of a metal saw or another metal cutting tool, so that the length of the water collecting body 6 can be adapted to the floor tile format or the size of an adjacent floor covering slab if necessary.

The invention claimed is:

1. A floor drain for draining water from a walk-in floor into a sewerage pipe, the floor drain comprising:

an inlet channel socket;

a first receiving body for the inlet channel socket;

a second receiving body for the first receiving body; and a drain housing following the second receiving body in the water drainage direction, wherein the first receiving body has a bowl-shaped section having a flexible sealing mat connected in a liquid-tight manner to an outer edge thereof, wherein a bottom of the bowl-shaped section passes into a first drain connection piece which is configured to be inserted into the second receiving body, wherein the second receiving body has a bowl-shaped portion on which an outwardly projecting flange is integrally formed or attached, and wherein the bowl-shaped portion of the second receiving body passes into a second drain connection piece.

2. The floor drain according to claim 1, wherein the first drain connecting piece comprises an annular seal arranged on the outer circumference thereof.

3. The floor drain according to claim 1, wherein the bowl-shaped section of the first receiving body and the bowl-shaped section of the second receiving body comprise mutually associated snap-in elements which are configured to be locked together when the bowl-shaped section of the first receiving body is arranged in the bowl-shaped section of the second receiving body.

4. The floor drain according to claim 1, wherein the bowl-shaped section of the first receiving body and the bowl-shaped section of the second receiving body have at least four pairs of mutually associated snap-in elements which, when the bowl-shaped section of the first receiving body is arranged in the bowl-shaped section of the second receiving body, can be locked together, and wherein four of the snap-in elements are arranged on opposite outer sides of the bowl-shaped section of the first receiving body.

5. The floor drain according to claim 1, wherein the bowl-shaped section of the first receiving body is dimensioned larger than the inlet channel socket, so that the inlet channel socket is received in the bowl-shaped section so as to be horizontally displaceable relative to the bowl-shaped section of the first receiving body.

6. The floor drain according to claim 5, wherein the inlet channel socket is received in the bowl-shaped section of the first receiving body so as to be horizontally displaceable in at least two directions, the two directions extending transversely to one another.

7. The floor drain according to claim 1, wherein the inlet channel socket has at least one circumferential grooves on an outer circumference thereof.

8. The floor drain according to claim 1, wherein the outwardly projecting flange has at least one groove which runs parallel to an edge of the bowl-shaped section of the second receiving body, the at least one groove being spaced not more than 10 mm from the edge of the bowl-shaped section of the second receiving body.

9. The floor drain according to claim 1, wherein the second receiving body is rotatable about a vertical axis relative to the drain housing in liquid-tight connection with the drain housing.

10. The floor drain according to claim 9, wherein a protective cover is configured to cover the bowl-shaped portion of the second receiving body, the protective cover being positively and detachably connected to an edge of the bowl-shaped portion of the second receiving body.

11. The floor drain according to claim 1, wherein the inlet channel socket has a connecting section on an upper side for positive-locking and/or liquid-tight connection of a water collecting means, and wherein the water collecting means comprises an opening through which collected water can drain off.

12. The floor drain according to claim 1, comprising a water collecting means having an opening through which collected water can drain off.

13. The floor drain according to claim 12, wherein the water collecting means comprises an insert receptacle above the bowl-shaped portion of the second receiving body, the insert receptacle configured to positively receive an insert therein, wherein the insert comprises the opening.

14. The floor drain according to claim 1, wherein the bowl-shaped section of the first receiving body comprises a sieve insert.

15. The floor drain according to claim 8, wherein the at least one groove is spaced no more than 5 mm from the edge of the bowl-shaped section of the second receiving body.

16. The floor drain according claim 11, wherein the water collecting means comprises a water collecting body having multiple gradients.

17. The floor drain according to claim 12, wherein the water collecting means comprises an elongated water collecting body having multiple gradients.

18. The floor drain according to claim 12, wherein the opening is gap-shaped opening.

19. The floor drain according to claim 1, wherein the drain housing is designed as an odor trap.

* * * * *